US011557446B1

(12) United States Patent
Atienza

(10) Patent No.: US 11,557,446 B1
(45) Date of Patent: Jan. 17, 2023

(54) KEYBOARD STABILIZER ADAPTED FOR NOISE REDUCTION

(71) Applicant: Jeremy Atienza, Los Angeles, CA (US)

(72) Inventor: Jeremy Atienza, Los Angeles, CA (US)

( * ) Notice: Subject to any disclaimer, the term of this patent is extended or adjusted under 35 U.S.C. 154(b) by 0 days.

(21) Appl. No.: 17/515,459

(22) Filed: Oct. 30, 2021

(51) Int. Cl.
*H01H 13/84* (2006.01)
*H01H 13/88* (2006.01)

(52) U.S. Cl.
CPC ..... *H01H 13/84* (2013.01); *H01H 13/88* (2013.01); *H01H 2221/058* (2013.01); *H01H 2221/062* (2013.01)

(58) Field of Classification Search
CPC .. H01H 13/84; H01H 13/88; H01H 2221/058; H01H 2221/062
USPC ..... 200/344
See application file for complete search history.

(56) References Cited

U.S. PATENT DOCUMENTS 5,758,763 A * 6/1998 Sanda ..... H01H 3/125 200/344
2017/0194109 A1* 7/2017 Ren ..... H01H 3/122

OTHER PUBLICATIONS

Bephamart, "2x 6.25x PCB Mount Mechanical Keyboard Cap Stabilizer for Cherry MX Switch", https://www.amazon.com/Mechanical-Keyboard-Stabilizer-Cherry-Switch/dp/B0725N5DG7 (accessed and archived Sep. 1, 2021).
Zhanlida Adhesive, "Zhanlida T7000 Black Contact Adhesive Repair Glue With Precision Applicator Tip-110ML", https://www.zhanlidaadhesive.com/product/zhanlida-t7000-black-contact-adhesive-repair-glue-with-precision-applicator-tip-110ml/?v=7516fd43adaa (accessed and archived Sep. 2, 2021).
Zhanlida Adhesives, "Zhanlida E8000 Clear Contact Adhesive With Precision Applicator Tip-110ML", https://www.zhanlidaadhesive.com/product/zhanlida-e8000-clear-contact-adhesive-with-precision-applicator-tip-110ml/?v=7516fd43adaa (accessed and archived Sep. 2, 2021).
Kebo, "Krytox lubricants", https://kebo.store/products/krytox-lubricants (accessed and archived Sep. 2, 2021).

* cited by examiner

*Primary Examiner* — Edwin A. Leon
*Assistant Examiner* — Iman Malakooti
(74) *Attorney, Agent, or Firm* — Scot Fagerland

(57) ABSTRACT

A keyboard stabilizer is adapted to reduce the clanking and rattling sounds that it makes during operation. The invention takes advantage of the surprising result that adhesive, in proper amounts, can act as a sound dampener. First, a circumferential score is cut near each tip of the wire. Second, adhesive is applied to several critical points on the housings, stems, and wire. Third, lubricant is applied to several critical points on the housings, stems, and wire. The stabilizer is then assembled from the prepared parts.

10 Claims, 10 Drawing Sheets

KEYBOARD STABILIZER ADAPTED FOR NOISE REDUCTION

1. FIELD OF THE INVENTION

This invention is in the field of computer keyboard mechanics, specifically key stabilizers.

2. BACKGROUND OF THE INVENTION

The invention is a modified version of a keyboard stabilizer, which is an existing mechanism in a standard computer keyboard. The keys that are wider than the alphanumeric keys are stabilized for steady activation. Every keyboard has at least five stabilized keys: Backspace, Enter, Shift (left), Shift (right), and the Spacebar. Full keyboards with a number pad have three more wide/stabilized keys.

3. DESCRIPTION OF RELATED TECHNOLOGY

There are numerous stabilizers on the market, with Cherry, Durock, and Zeal being the industry leaders. Today's stabilizers are all functionally the same. They all rattle and clank without modifications, and they all come disassembled. A typical keyboard stabilizer is shown in FIG. 1.

There are three mounting types for modern keyboard stabilizers:

A plate-mounted stabilizer attaches to the substrate that holds the key switches, usually a metal plate.

A PCB clip-in stabilizer attaches to the electronic printed circuit board (PCB) inside the keyboard; it is clipped into place.

A PCB screw-in stabilizer also attaches to the electronic board inside the keyboard, but it is fastened on by a screw rather than clip retention.

All these types of stabilizers are assembled using three primary components: the housing 11, the stem 12, and the wire 13. The wire varies in length depending on the width of the key.

A fully assembled stabilizer will consist of a pair of housings, with a pair of stems, connected by one wire. The stems are inserted into the housing. The housing has housing hole 111 and the stem has stem hole 121. Each end of the wire is inserted through a stem hole and a housing hole, then clipped on to a wire clamp 112 on the housing. The tops of the stems are attached to the underside of a key on the keyboard. The assembly ensures that the left and right edges of the key are depressed at equal velocity, so the key does not wobble, misfire, or stick.

4. SUMMARY OF THE INVENTION

The present invention is a stabilizer adapted to address the primary imperfections of products on the market. Out of the box, the aforementioned stabilizers produce an unpleasant clank and rattling noise. The present invention involves the application of adhesive and grease to critical areas to remove said noises. It is prefabricated and ready to install out of the box without further tuning or modification.

As an unexpected result, the adhesive serves effectively to dampen stabilizer noise. Adhesive has not been used for this purpose in the known prior art. The amount of adhesive to apply is critical. There must be enough adhesive to dampen sound, but not enough to adhere strongly. It is also critical to let the adhesive dry before lubricating or assembling the parts.

5. BRIEF DESCRIPTION OF THE DRAWINGS

FIG. 1 depicts a fully assembled keyboard stabilizer.

FIGS. 2*a*-2*d* show the components of the stabilizer, separately and then assembled. FIG. 2*a* is a side view of a housing. FIG. 2*b* is a side view of a stem. FIG. 2*c* is a top view of the wire. FIG. 2*d* is a top view of the assembled stabilizer.

Figure 5A:
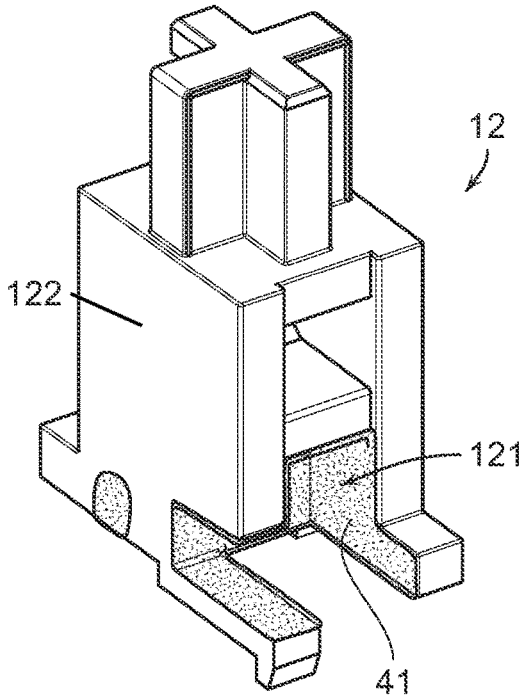
Figure 5B:
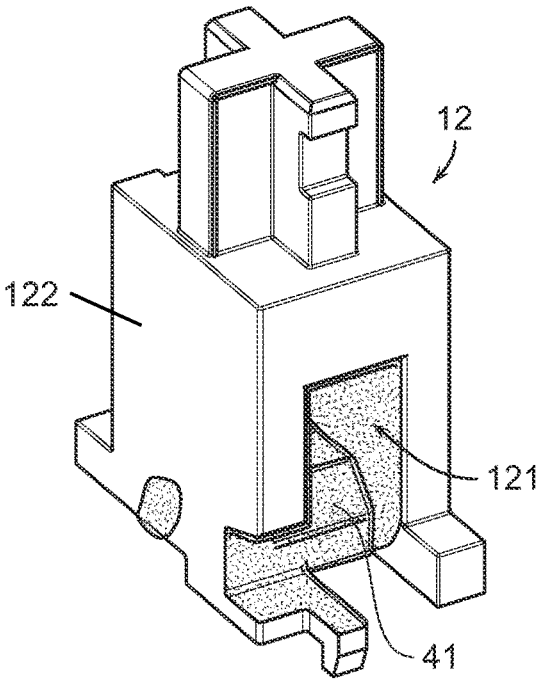
Figure 5C:
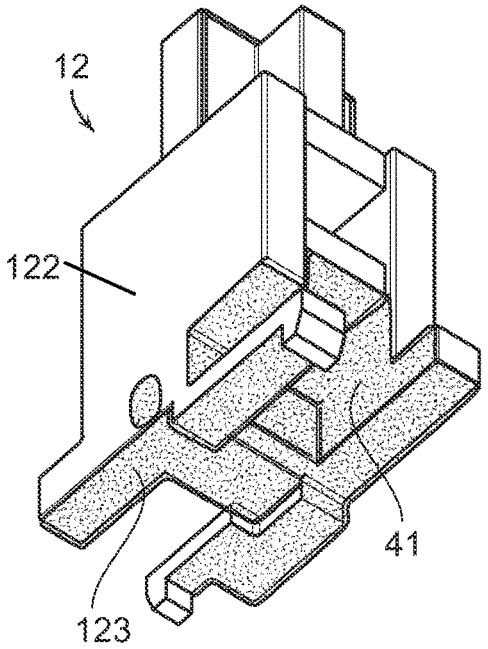

FIGS. 5*a*-5*c* present multiple views of a stem with adhesive applied. FIG. 5*a* shows the front of the stem. FIG. 5*b* shows the back of the stem. FIG. 5*c* shows the bottom of the stem.

Figure 6A:
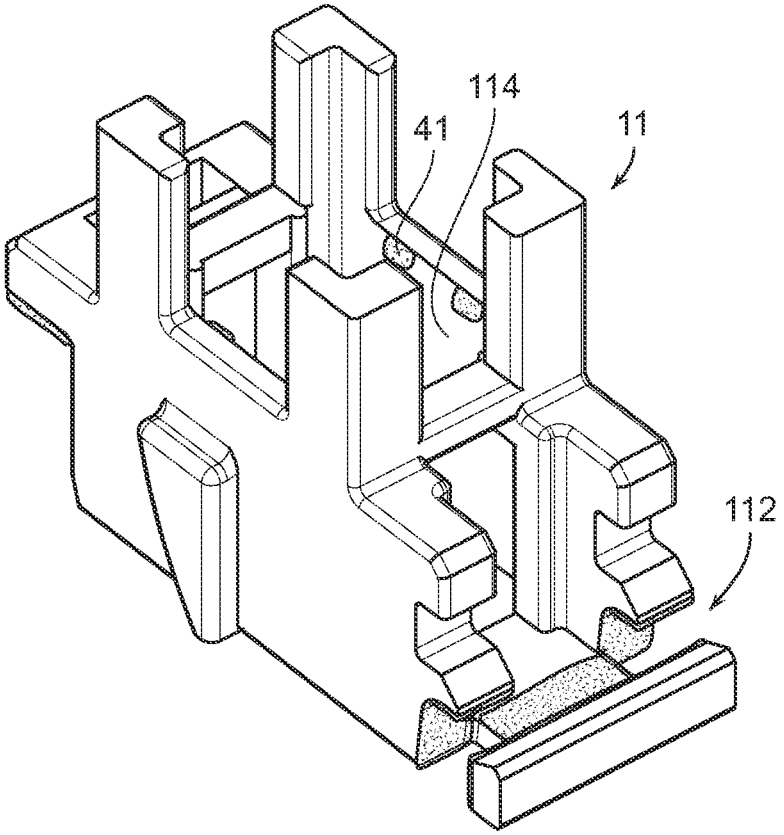
Figure 6B:
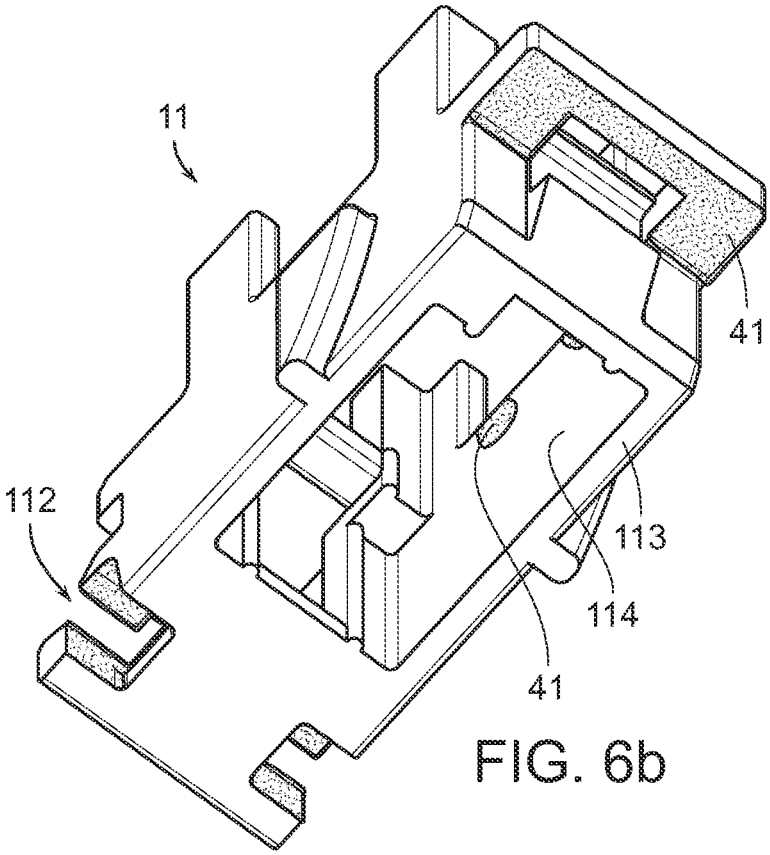

FIGS. 6*a* and 6*b* present two views of a plate-mounted housing with adhesive applied. FIG. 6*a* shows the front of the housing. FIG. 6*b* shows the back of the housing.

Figure 7A:
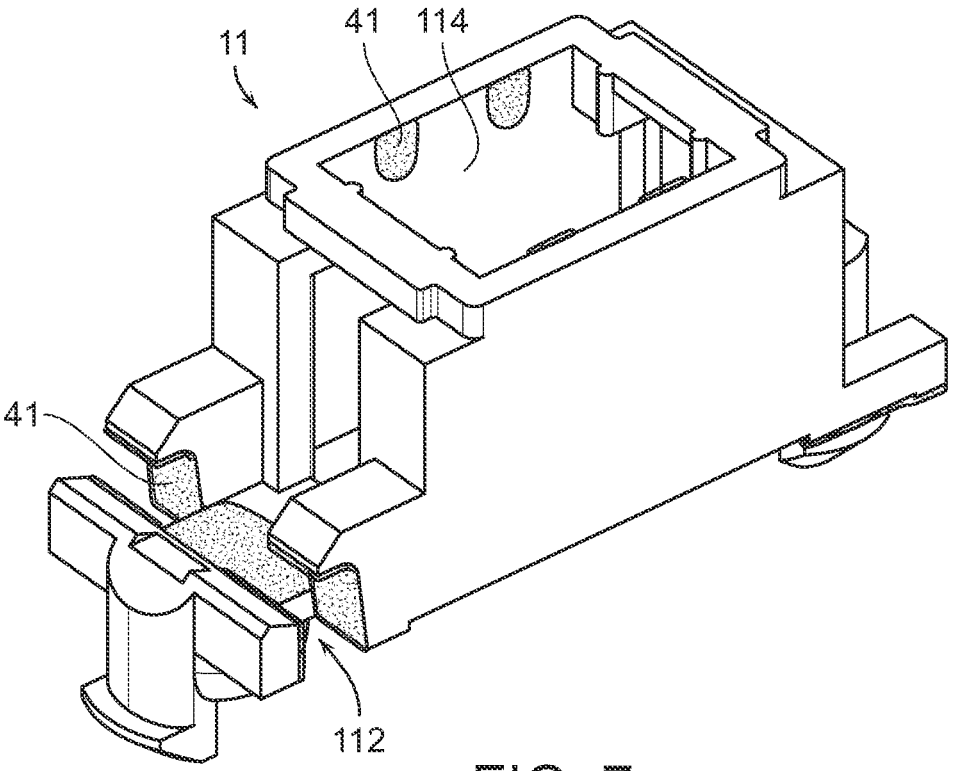
Figure 7B:
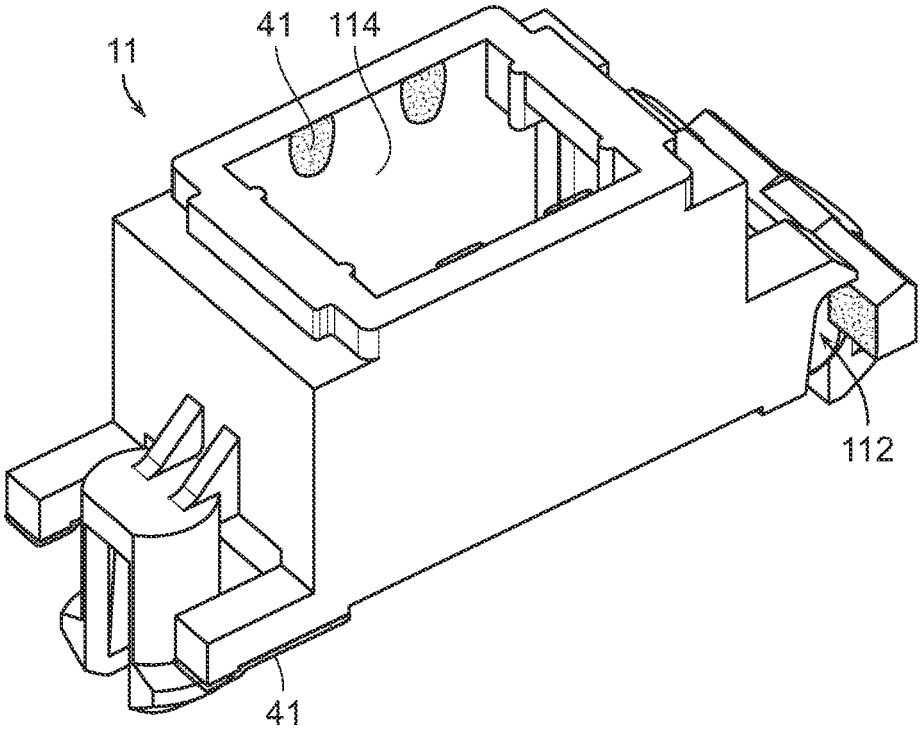

FIGS. 7*a* and 7*b* present two views of a housing with adhesive applied. FIG. 7*a* shows the front end of the housing. FIG. 7*b* shows the back end of the housing.

Figure 8A:
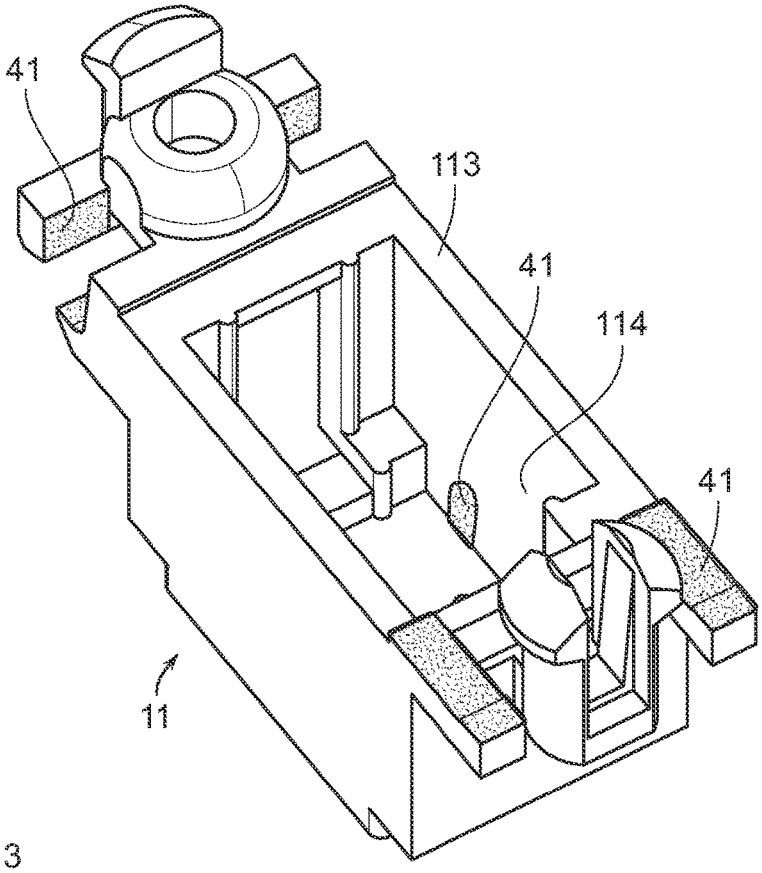
Figure 8B:
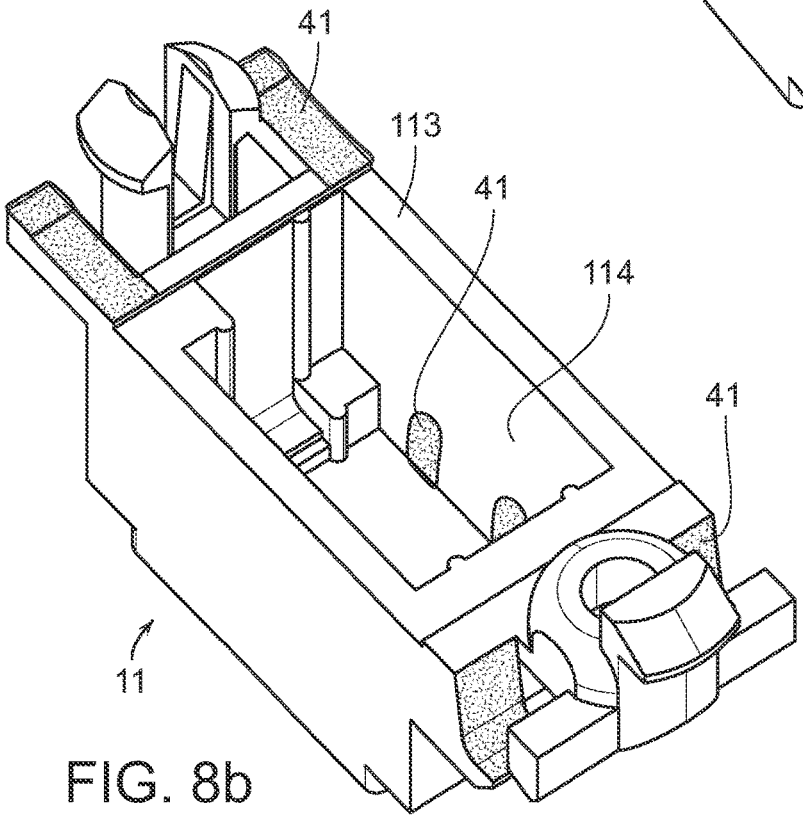

FIGS. 8*a* and 8*b* present two additional views of a housing with adhesive applied. FIG. 8*a* shows the top of the housing. FIG. 8*b* shows the bottom of the housing.

Figure 9:
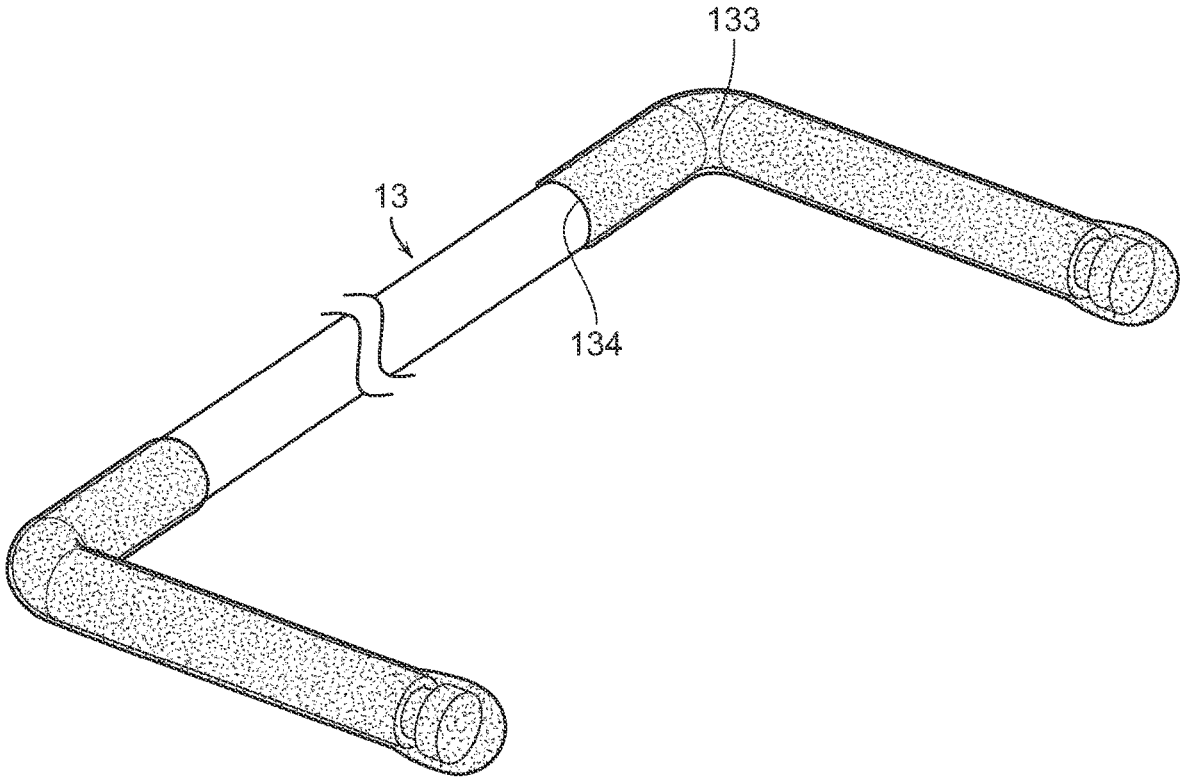

FIG. 9 shows the zone where lubricant is applied to the bent ends of a wire.

6. DETAILED DESCRIPTION OF THE PREFERRED EMBODIMENTS

Preparation of this invention involves the primary steps of (1) cutting scores near each tip of the wire, (2) applying adhesive to critical points of the stabilizer components and allowing time for the adhesive to set, (3) applying lubricant to key points of the stabilizer components, and (4) assembling the components.

The adhesive is not used to glue the components together. Rather, the application of adhesive and lubricant has the unexpected result of making the keyboard stabilizer operate more quietly than an unmodified stabilizer. The use of adhesive and lubricant for noise-dampening effects is a novel application, previously unknown in this industry.

The locations and amounts of adhesive are critical. If too little adhesive is used, the noise-dampening effect is not realized. If too much adhesive is used, the key gets stuck.

Figure 3:
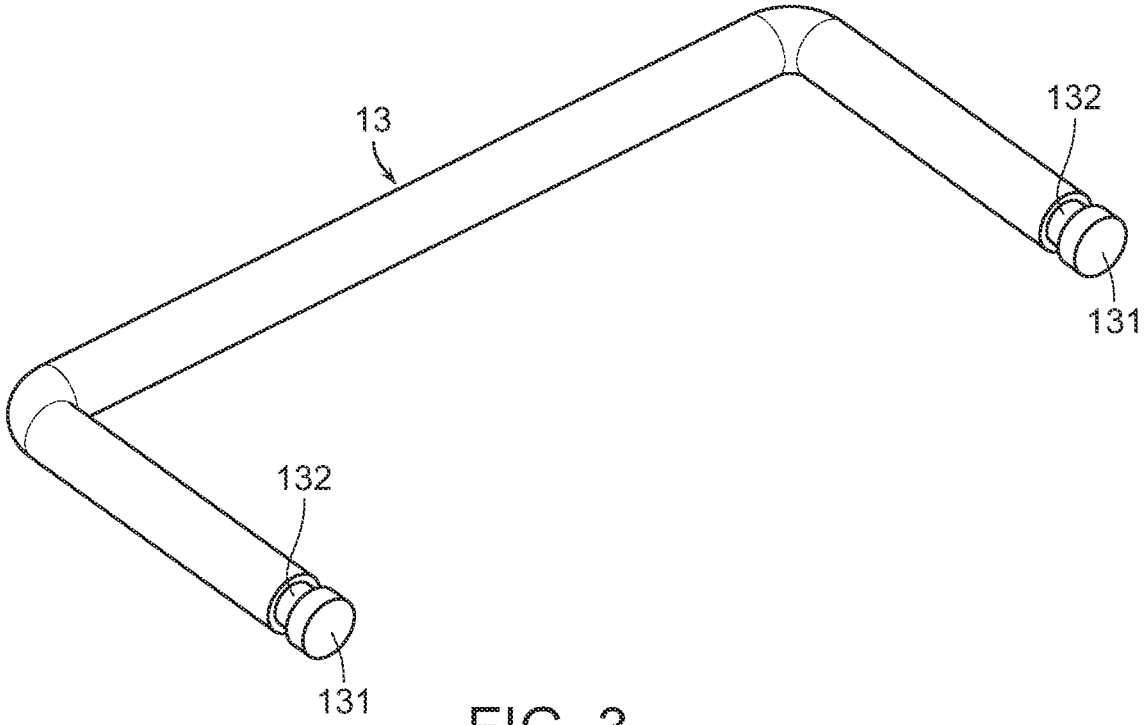
FIG. 3 shows a wire with a circumferential score cut near both tips.
Figure 4:
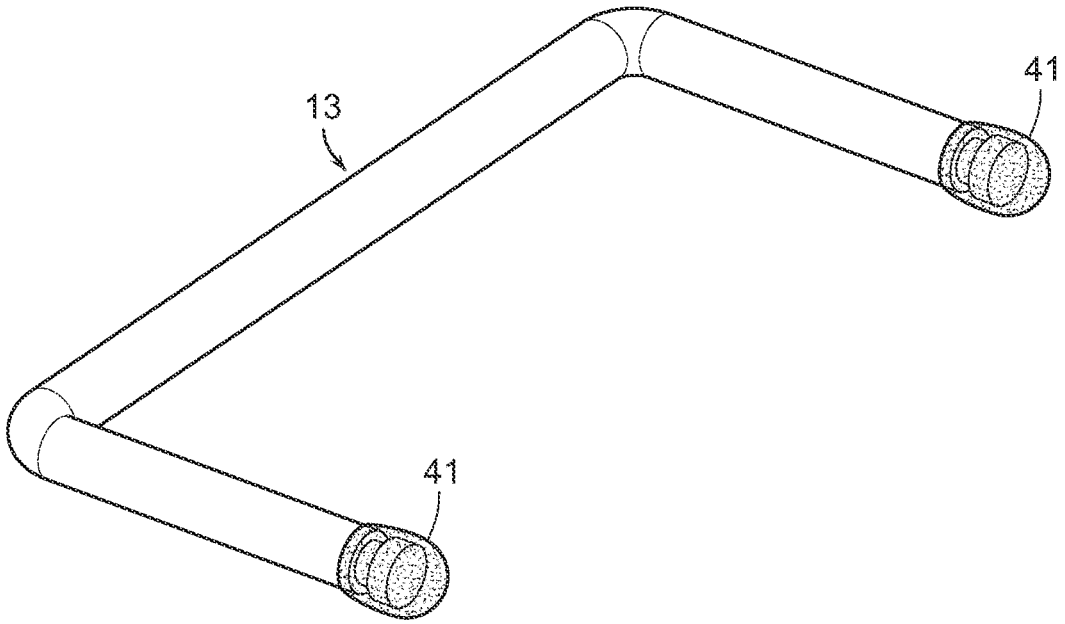
FIG. 4 shows a wire with adhesive applied to each tip.

To begin preparing the invention, a circumferential score 132 is cut near each tip 131 of the wire 13. This score is best seen in FIG. 3. As shown in FIG. 4, adhesive 41 is then applied to each tip of the wire. The circumferential scores hold the adhesive optimally. The ideal amount of adhesive is 0.2 mL on each end, for a total of 0.4 mL on each wire.

The optimal adhesives are from manufacturer Zhanlida, specifically industrial strength formulae T-7000 (black acrylic adhesive) or E-8000 (clear epoxy resin liquid glue). For the purposes of this disclosure, T-7000 adhesive is illustrated so it can be clearly seen in the figures.

Adhesive 41 is applied to each stem 12, in the locations seen in FIGS. 5*a*, 5*b*, and 5*c*. Adhesive is coated along the inside walls of stem hole 121 where the wire will be inserted. The ideal amount of adhesive to apply to the inside walls of the stem hole is 0.3 mL. The stem base 123 is coated with adhesive 41 to prevent noise and vibration upon PCB impact (FIG. 5*c*). The ideal amount of adhesive to apply to the stem base is 0.4 mL. Adhesive is applied to the stem outer wall 122. The ideal amount of adhesive at this point is 0.03 mL on each side of the stem outer wall, for a total of 0.06 mL on each stem.

If the housing 11 is plate-mounted, as shown in FIGS. 6*a* and 6*b*, then adhesive 41 is applied to the front left, front right, rear left, and rear right fastening mechanisms 115 where the stabilizer fastens to the keyboard plate. The ideal amount of adhesive to apply is 0.05 mL on each fastening mechanism, for a total of 0.2 mL on each plate-mounted housing.

For all housings, adhesive is applied to both sides of the wire clamp 112, as shown in FIGS. 7*a* and 7*b*. The ideal amount of adhesive to apply to the wire clamp is 0.05 mL on each side, or 0.1 mL altogether.

For all housings, adhesive is applied to the housing base 113, where the wire contacts the housing in the down position. This application is shown in FIGS. 8*a* and 8*b*. The ideal amount of adhesive to apply to the housing base is 0.2 mL.

For all housings, adhesive is applied to the housing inner wall, part 114 in FIGS. 8*a* and 8*b*. The ideal amount is 0.03 mL per point, at four points, for a total of 0.12 mL on each housing.

Upon application, there is a curing time for the adhesive so that it will no longer be tacky, usually 24-48 hours.

After the adhesive cures, lubricant is applied to critical points of the components. The optimal known lubricant is Krytox 205G0, a grade 0 grease lubricant. The lubricant is clear, and often applied over adhesive, so it is not always visible in the illustrations. The amount of lubricant is not as critical as the amount of adhesive. Nevertheless, appropriate amounts are disclosed where they are known.

Lubricant is applied to the housing inner walls 114, as pointed out in FIG. 8*a*. An appropriate amount of lubricant at this point is 0.2 mL.

Lubricant is applied to the housing base 113, as pointed out in FIGS. 8*a* and 8*b*. An appropriate amount of lubricant at this point is 0.05 mL.

Figure 1:
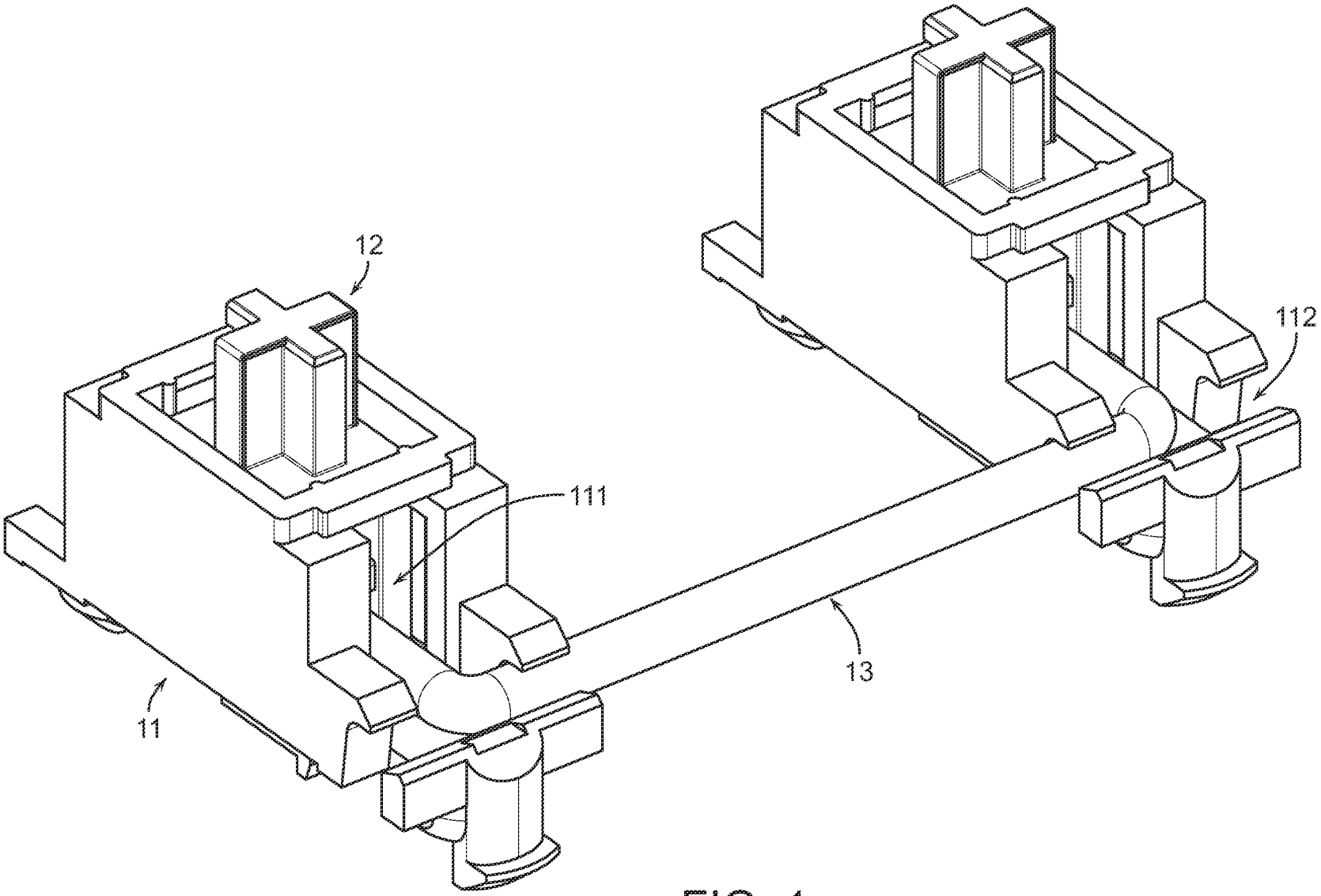
Figure 2A:
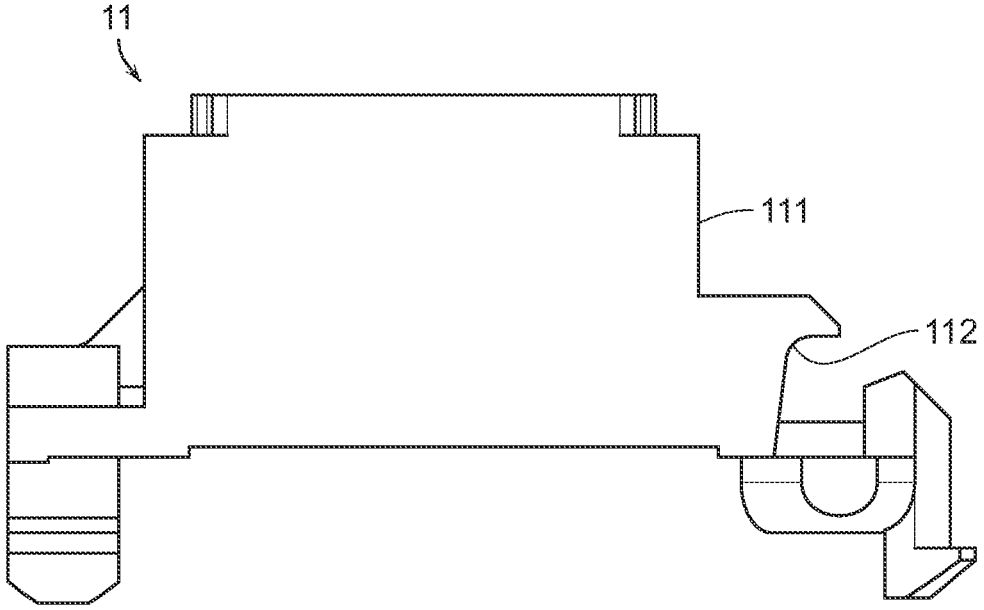
Figure 2B:
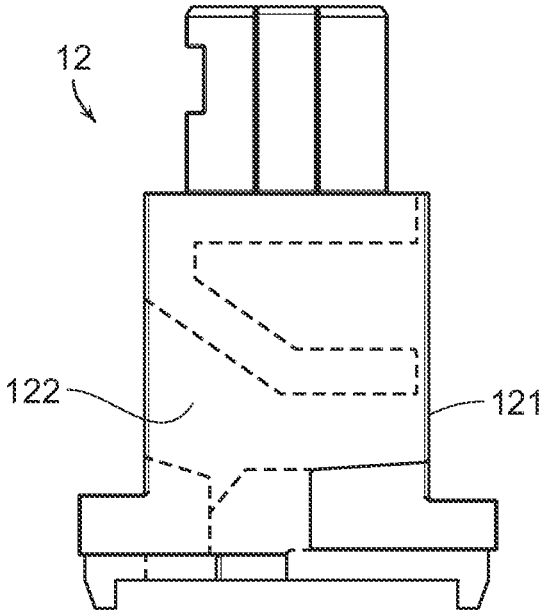
Figure 2C:
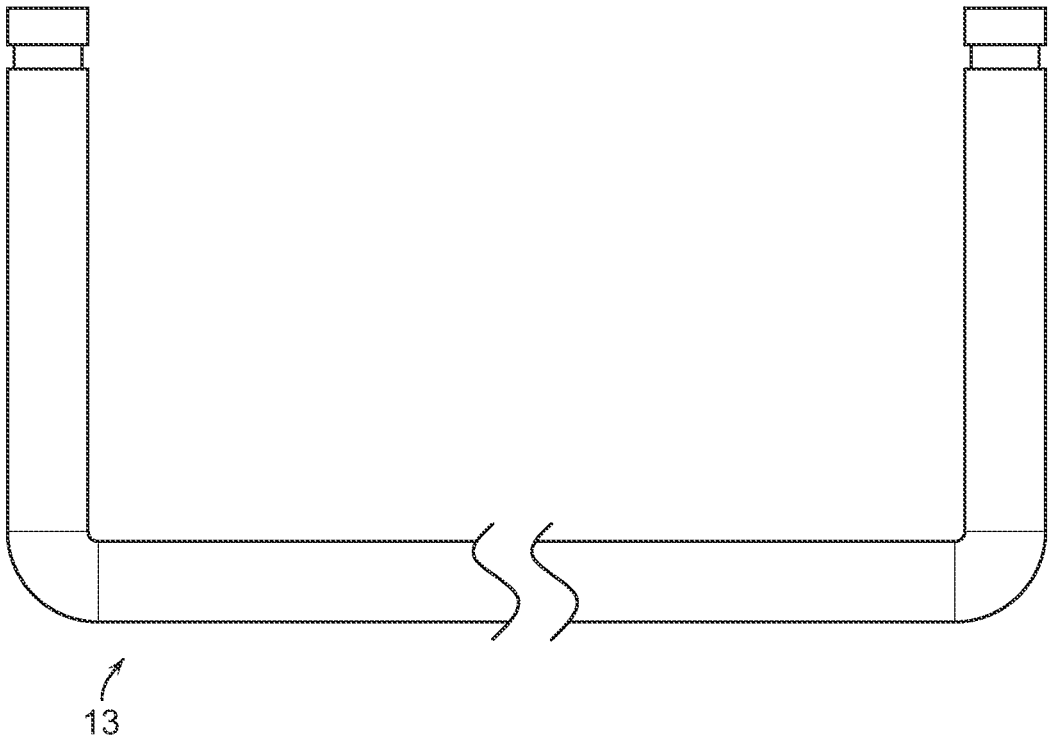
Figure 2D:
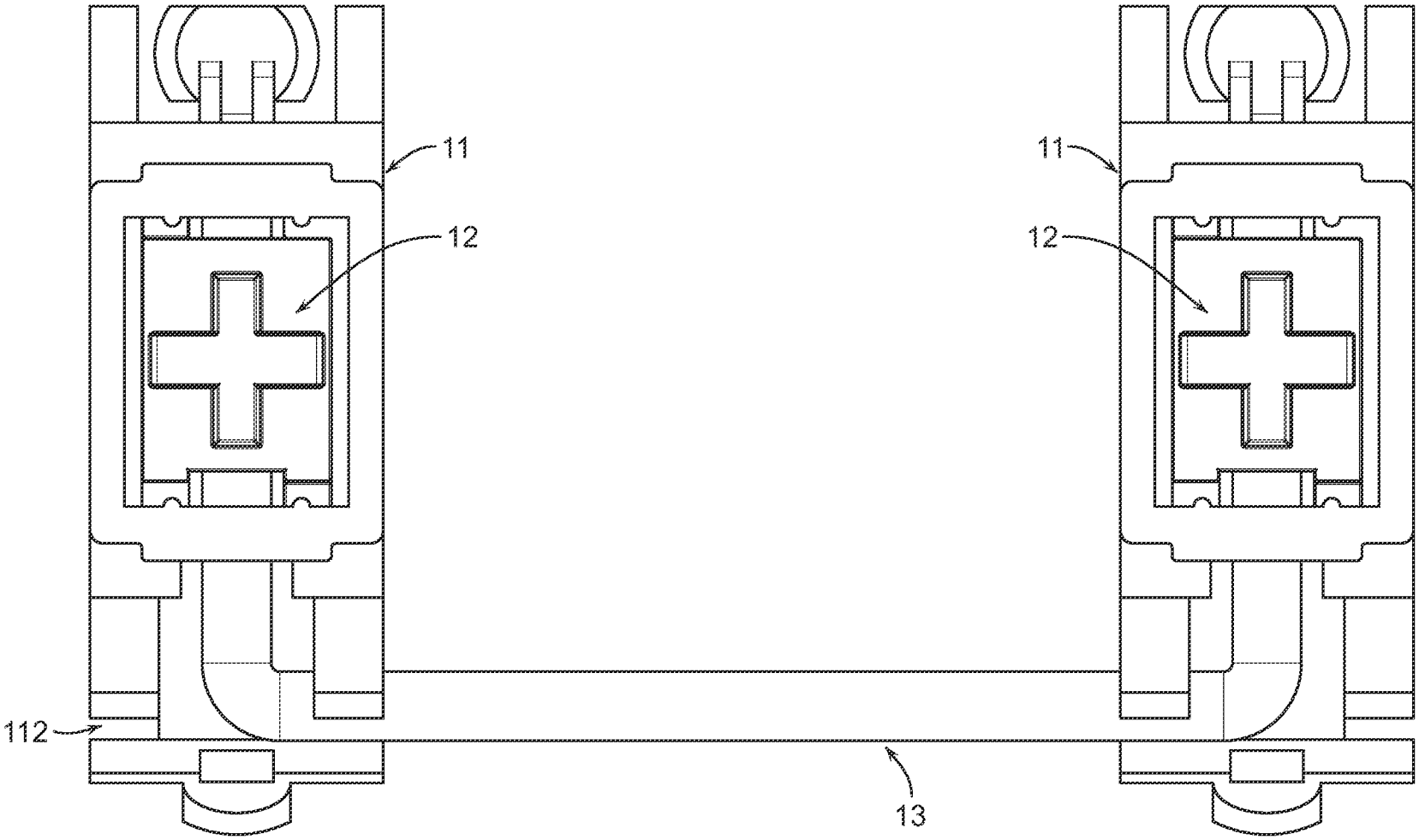

Lubricant is applied to the stem outer walls 122, as seen in FIG. 2*b*. An appropriate amount of lubricant at this point is 0.1 mL.

Lubricant is applied to the stem hole 121 of each stem, as best seen in FIG. 5*a*. An appropriate amount of lubricant at this point is 0.1 mL.

Lubricant is applied to each bent end 133 of the wire, as shown in FIG. 9. The lubricant is applied from the tip 131 to the endpoint 134 where the wire clips to the housing. An appropriate amount of lubricant is 0.3 mL for each bent end of the wire.

Finally, all components are assembled into a complete keyboard stabilizer.

Due to the matter of installation, this invention is best suited to PCB screw in/snap in stabilizers. These forms mount consistently to printed circuit boards. Plate mounts, by contrast, can be made of aluminum, polycarbonate, brass, or carbon fiber, materials that differ in rigidity.

I claim:

1. A process for adapting a keyboard stabilizer for noise reduction, comprising the steps of:

providing two housings, each housing comprising a housing hole, a wire clamp, a housing base, and a housing inner wall;

providing two stems, each stem comprising a stem hole, a stem outer wall, and a stem base;

providing a wire, comprising two bent ends and a tip on each bent end;

applying adhesive to the wire clamp, housing base, and housing inner wall of each housing;

applying adhesive to the stem hole, stem base, and stem outer wall of each stem;

cutting a circumferential score around each bent end of the wire, near the tip of each bent end;

applying adhesive to the tip of each bent end of the wire;

wherein the adhesive applied to the wire clamp of each housing has a volume in the range of 0.05 to 0.15 mL;

the adhesive applied to the housing base of each housing has a volume in the range of 0.15 to 0.25 mL;

the adhesive applied to the housing inner wall of each housing has a volume in the range of 0.10 to 0.14 mL;

the adhesive applied to the stem hole of each stem has a volume in the range of 0.25 to 0.35 mL;

the adhesive applied to the stem base of each stem has a volume in the range of 0.35 to 0.45 mL;

the adhesive applied to the stem outer wall of each stem has a volume in the range of 0.05 to 0.07 mL;

and the adhesive applied to the tip of each bent end of the wire has a volume in the range of 0.15 to 0.25 mL;

allowing all applied adhesive at least one day to cure;

applying lubricant to the housing inner wall and the housing base of each housing;

applying lubricant to the stem outer wall and the stem hole of each stem;

applying lubricant to each bent end of the wire;

and assembling the housings, the stems, and the wire into a keyboard stabilizer.

2. The process of claim 1, wherein the adhesive is selected from the list consisting of acrylic adhesive and epoxy resin liquid glue.

3. The process of claim 2, wherein the lubricant applied to the housing inner wall of each housing has a volume in the range of 0.15 to 0.25 mL;

the lubricant applied to the housing base of each housing has a volume in the range of 0.045 to 0.055 mL;

the lubricant applied to the stem outer wall of each stem has a volume in the range of 0.05 to 0.15 mL;

the lubricant applied to the stem hole of each stem has a volume in the range of 0.05 to 0.15 mL;

and the lubricant applied to each bent end of the wire has a volume in the range of 0.25 to 0.35 mL.

4. The process of claim 3, wherein the lubricant is a grade 0 grease lubricant.

5. The process of claim 4, wherein each housing further comprises a plurality of fastening mechanisms for mounting to a keyboard plate;

and adhesive in an amount of 0.15 to 0.25 mL is applied to the plurality of fastening mechanisms of the housing.

6. A keyboard stabilizer modified for noise reduction, comprising two housings, each housing comprising a housing hole, a wire clamp, a housing base, and a housing inner wall;

two stems, each stem comprising a stem hole, a stem outer wall, and a stem base;

a wire, comprising two bent ends and a tip on each bent end;

adhesive on the wire clamp, housing base, and housing inner wall of each housing;

adhesive on the stem hole, stem base, and stem outer wall of each stem;

a circumferential score around each bent end of the wire, near the tip of each bent end;

adhesive on the tip of each bent end of the wire;

wherein the adhesive on the wire clamp of each housing has a volume in the range of 0.05 to 0.15 mL;

the adhesive on the housing base of each housing has a volume in the range of 0.15 to 0.25 mL;

the adhesive on the housing inner wall of each housing has a volume in the range of 0.10 to 0.14 mL;

the adhesive on the stem hole of each stem has a volume in the range of 0.25 to 0.35 mL;

the adhesive on the stem base of each stem has a volume in the range of 0.35 to 0.45 mL;

the adhesive on the stem outer wall of each stem has a volume in the range of 0.05 to 0.07 mL;

and the adhesive on the tip of each bent end of the wire has a volume in the range of 0.15 to 0.25 mL;

lubricant on the housing inner wall and the housing base of each housing;

lubricant on the stem outer wall and the stem hole of each stem;

and lubricant on each bent end of the wire.

7. The keyboard stabilizer of claim 6, wherein the adhesive is selected from the list consisting of acrylic adhesive and epoxy resin liquid glue.

8. The keyboard stabilizer of claim 7, wherein the lubricant on the housing inner wall of each housing has a volume in the range of 0.15 to 0.25 mL;

the lubricant on the housing base of each housing has a volume in the range of 0.045 to 0.055 mL;

the lubricant on the stem outer wall of each stem has a volume in the range of 0.05 to 0.15 mL;

the lubricant on the stem hole of each stem has a volume in the range of 0.05 to 0.15 mL;

and the lubricant on each bent end of the wire has a volume in the range of 0.25 to 0.35 mL.

9. The keyboard stabilizer of claim 8, wherein the lubricant is a grade 0 grease lubricant.

10. The keyboard stabilizer of claim 9, wherein each housing further comprises a plurality of fastening mechanisms for mounting to a keyboard plate;

and adhesive in an amount of 0.15 to 0.25 mL is on the plurality of fastening mechanisms of the housing.

* * * * *